US010573210B2

(12) United States Patent
Chen

(10) Patent No.: US 10,573,210 B2
(45) Date of Patent: Feb. 25, 2020

(54) TEST CIRCUIT, ARRAY SUBSTRATE, AND LIGHT-EMITTING DISPLAY APPARATUS

(71) Applicant: Wuhan China Star Optoelectronics Semiconductor Display Technology Co., Ltd., Wuhan, Hubei (CN)

(72) Inventor: Caiqin Chen, Guangdong (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 0 days.

(21) Appl. No.: 16/124,234

(22) Filed: Sep. 7, 2018

(65) Prior Publication Data

US 2019/0325796 A1 Oct. 24, 2019

Related U.S. Application Data

(63) Continuation of application No. PCT/CN2018/096922, filed on Jul. 25, 2018.

(30) Foreign Application Priority Data

Apr. 19, 2018 (CN) ..... 2018 1 0355230

(51) Int. Cl.
*G09G 3/3266* (2016.01)
*G09G 3/00* (2006.01)

(52) U.S. Cl.
CPC ..... *G09G 3/006* (2013.01); *G09G 3/3266* (2013.01); *G09G 2300/0819* (2013.01); *G09G 2330/12* (2013.01)

(58) Field of Classification Search
CPC ..... G09G 3/006; G09G 3/3266; G09G 2300/0819; G09G 2330/12
See application file for complete search history.

(56) References Cited

U.S. PATENT DOCUMENTS

| | | | | |
|---|---|---|---|---|
| 9,824,618 | B2 * | 11/2017 | Ohara | G09G 3/3233 |
| 2008/0062089 | A1 | 3/2008 | Kim et al. | |
| 2009/0152441 | A1 * | 6/2009 | Pak | G01J 1/08 250/205 |
| 2015/0206477 | A1 | 7/2015 | Ku | |
| 2015/0379928 | A1 | 12/2015 | Zhang | |
| 2017/0263186 | A1 | 9/2017 | Wang et al. | |
| 2017/0330512 | A1 | 11/2017 | Zhou | |
| 2019/0080650 | A1 * | 3/2019 | Fu | G09G 3/3258 |

FOREIGN PATENT DOCUMENTS

CN 106707641 A 5/2017

* cited by examiner

*Primary Examiner* — Lisa S Landis

(57) ABSTRACT

The present disclosure discloses a test circuit, an array substrate, and a light-emitting display apparatus. The test circuit is arranged at an output terminal of a scan driving circuit and is configured to test a current output characteristic of a pixel unit when the scan driving circuit does not provide a drive signal for the pixel unit. Test circuit includes an enable signal line, a scanning signal ON line, and a plurality of switch transistors. Each of the switch transistors includes a first terminal, a second terminal, and a third terminal, wherein the first terminal of each of the switch transistors connects the enable signal line, the second terminal connects the scanning signal ON line, and the third terminal connects the pixel unit.

18 Claims, 3 Drawing Sheets

TEST CIRCUIT, ARRAY SUBSTRATE, AND LIGHT-EMITTING DISPLAY APPARATUS

CROSS-REFERENCE TO RELATED APPLICATIONS

The present application is a continuation-application of International (PCT) Patent Application No. PCT/CN2018/096922 filed on Jul. 25, 2018, which claims foreign priority of Chinese Patent Application No. 201810355230.8, filed on Apr. 19, 2018 in the State Intellectual Property Office of China, the contents of all of which are hereby incorporated by reference.

TECHNICAL FIELD

The present disclosure generally relates to the field of display technologies, and more particularly, to a test circuit, an array substrate, and a light-emitting display apparatus.

BACKGROUND

In an active-matrix organic light emitting diode (AMOLED), generally there is provided an array substrate and an electroluminescence (EL) substrate. The array substrate provides a drive circuit, which includes a gate driving circuit, a scan driving circuit (Scan GOA), a control circuit (EM GOA), and a pixel driving circuit. The pixel driving circuit is configured to provide an anode voltage for an EL pixel, the gate driving circuit is configured to provide a pixel voltage, a reset (Vi) drive line is configured to provide an anode resetting voltage, and a voltage (Vdd) drive line is configured to provide a pixel driving voltage. A common voltage (Vss) is a cathode input voltage of the EL pixel, etc. In panel resolution, to differentiate EL device problems, device characteristics may be monitored only by means of inline random inspection. However, when it is impossible to inquire inline device characteristics data for panel problems fed back by modules or clients, it is required to further analyze locations where the problems occur so as to further analyze causes of the problems. Therefore, it is urgently needed to test unit circuits to differentiate Array and EL problems or detect EL output current characteristics to provide convenience for resolution.

Furthermore, it is necessary to individually fabricate EL masks (fine metal masks and common metal masks) to shield the effect of the array substrate during EL recipe debugging so as to test EL current output characteristic and debug the structure of the EL device, which increases development costs to a large extent.

SUMMARY

The present disclosure provides a test circuit, an array substrate, and a light-emitting display apparatus, which can determine a location having a negative effect on light emission of an EL light-emitting device, and make it unnecessary to individually fabricate a mask for the EL light-emitting device to shield the effect of a drive circuit in the array substrate during EL recipe debugging, thereby saving product development costs.

To solve the above technical problems, the present disclosure adopts a technical solution as below. There is provided a test circuit, which is arranged at an output terminal of a scan driving circuit. The test circuit is configured to test a current output characteristic of a pixel unit when the scan driving circuit does not provide a drive signal for the pixel unit. The test circuit includes an enable signal line, a scanning signal ON line, and a plurality of switch transistors, which are field-effect thin film transistors. Each of the switch transistors includes a first terminal, a second terminal, and a third terminal. The first terminal of each of the switch transistors connects the enable signal line, the second terminal connects the scanning signal ON line, and the third terminal connects the pixel unit. The test circuit further includes a reset signal line, wherein the reset signal line connects the pixel unit and is configured to provide a reset signal to reset the pixel unit.

To solve the above technical problems, the present disclosure adopts another technical solution as below. There is provided an array substrate, which includes a test circuit. The test circuit is arranged at an output terminal of a scan driving circuit and is configured to test a current output characteristic of a pixel unit when the scan driving circuit does not provide a drive signal for the pixel unit. The test circuit includes an enable signal line, a scanning signal ON line, and a plurality of switch transistors. Each of the switch transistors includes a first terminal, a second terminal, and a third terminal. The first terminal of each of the switch transistors connects the enable signal line, the second terminal connects the scanning signal ON line, and the third terminal connects the pixel unit.

To solve the above technical problems, the present disclosure adopts still another technical solution as below. There is provided a light-emitting display apparatus, which includes a scan driving circuit, a pixel unit and a test circuit connected in sequence. The test circuit is configured to test a current output characteristic of the pixel unit when the scan driving circuit does not provide a drive signal for the pixel unit. The test circuit includes an enable signal line, a scanning signal ON line, and a plurality of switch transistors. Each of the switch transistors includes a first terminal, a second terminal, and a third terminal. The first terminal of each of the switch transistors connects the enable signal line, the second terminal connects the scanning signal ON line, and the third terminal connects the pixel unit.

Beneficial effects of the present disclosure are as below. The present disclosure provides a test circuit, an array substrate, and a light-emitting display apparatus. By arranging the test circuit at an output terminal of a scan driving circuit to test a current output characteristic of a pixel unit without driving the scan driving circuit, a location having a negative effect on light emission of the EL light-emitting device may be determined, and it is unnecessary to individually fabricate a mask for the EL light-emitting device to shield the effect of a drive circuit in the array substrate during EL recipe debugging. Therefore, product development costs may be saved.

DETAILED DESCRIPTION

A clear and complete description of the technical schemes in the embodiments of the present disclosure will be made below with reference to the accompanying drawings in the embodiments of the present disclosure. Apparently, the embodiments as recited herein are merely a part of embodiments of the present disclosure instead of all embodiments. All other embodiments obtained by a person of ordinary skill in the art based on the embodiments of the present disclosure without creative efforts shall fall within the protection scope of the present disclosure.

Figure 1:
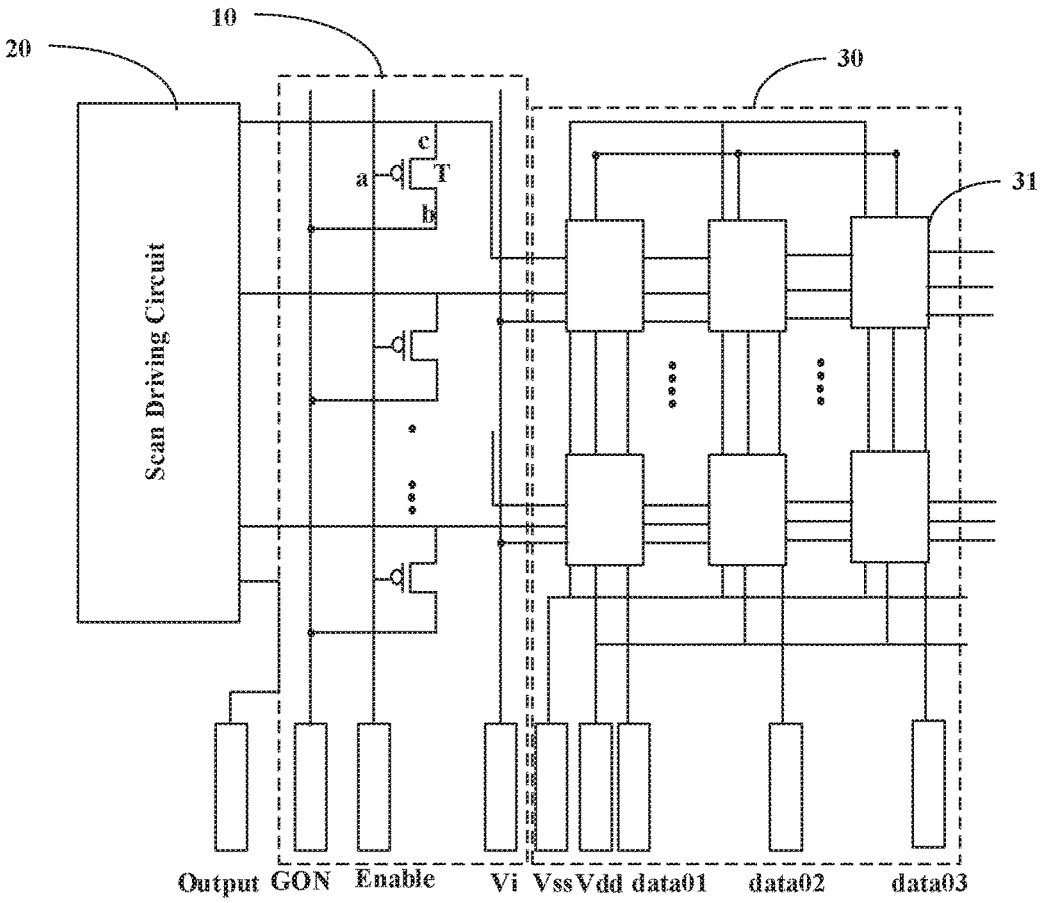
FIG. 1 is a schematic structural diagram of a test circuit according to an embodiment of the present disclosure.

Referring to FIG. 1, which is a schematic structural diagram of a test circuit according to an embodiment of the present disclosure. The test circuit 10 of the present disclosure may be arranged at an output terminal of a scan driving circuit 20, which may be configured to test a current output characteristic of a pixel unit 30 when the scan driving circuit 20 does not provide a drive signal for the pixel unit 30. The pixel unit 30 may include a plurality of array-arranged subpixel units 31.

The test circuit 10 may further include an enable signal line (Enable), a scanning signal ON line (GON), and a plurality of switch transistors T. Each of the switch transistors T may include a first terminal a, a second terminal b, and a third terminal c. The first terminal a of each of the switch transistors T may connect the enable signal line (Enable), the second terminal b connects the scanning signal ON line (GON), and the third terminal c may connect the pixel unit 30. The switch transistors T in this embodiment may be field-effect thin film transistors. The first terminal a, the second terminal b and the third terminal c may respectively correspond to a gate, a source and a drain of the field-effect thin film transistor (TFT). The field-effect thin film transistors in this embodiment may be N-type or P-type field-effect ones, which may be reasonably selected according to actual situations and are not further limited here.

Alternatively, the test circuit 10 may further include a reset signal line Vi, wherein reset signal line Vi may connect the pixel unit 30 to provide a reset signal to reset the pixel unit 30.

Figure 2:
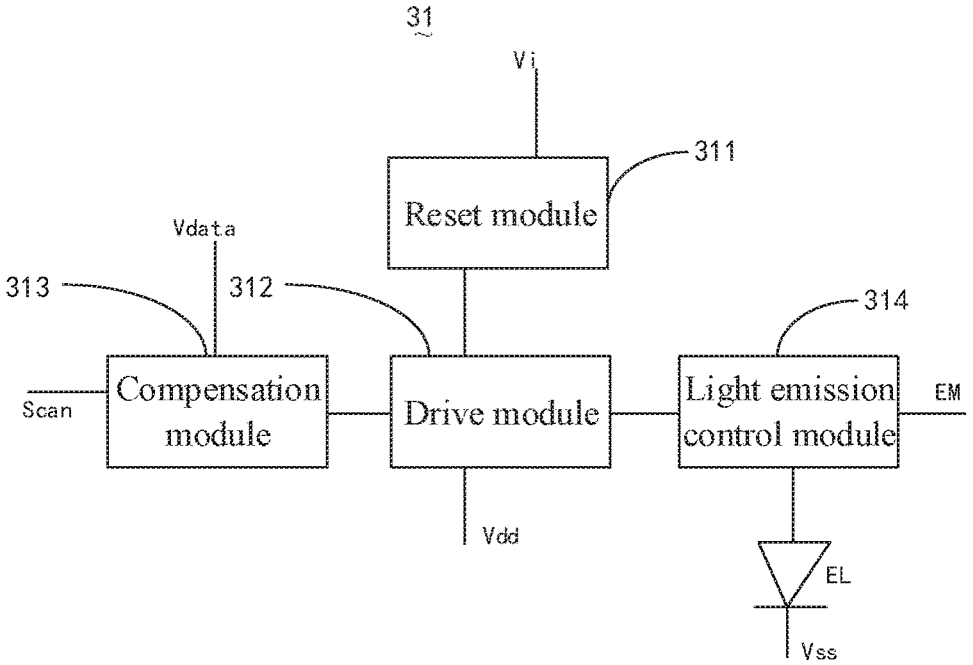
FIG. 2 is a schematic structural diagram of a subpixel unit according to one embodiment of the present disclosure.

Referring to FIG. 2, which is a schematic structural diagram of a pixel unit according to one embodiment of the present disclosure. Each subpixel unit 31 in the pixel unit 30 may include at least a reset module 311, a drive module 312, a compensation module 313, and a light emission control module 314.

The reset module 311 may connect the reset signal line Vi and the drive module 312 which may be configured to reset the drive module 312 based on a reset signal inputted from the reset signal line Vi. The drive module 312 may be configured to output a drive current to drive an EL light-emitting device to emit light. The compensation module 313 may connect a scanning signal control line Scan and the drive module 312 which may be configured to compensate a threshold voltage and write data for the drive module 312 under the control of a control signal inputted from the scanning signal control line Scan. The light emission control module 314 may connect a light emission control line EM, the drive module 312 and an anode of the EL light-emitting device which may be configured to control the drive module to drive the EL light-emitting device to emit light according to a light emission control signal inputted from the light emission control line EM.

Alternatively, the reset signal line Vi may connect the anode of the EL light-emitting device which may be configured to provide the reset signal in a test phase to reset the anode of the EL light-emitting device. A cathode of the EL light-emitting device may connect a common voltage VSS which may provide a low level signal for the EL light-emitting device in a test phase.

Figure 3:
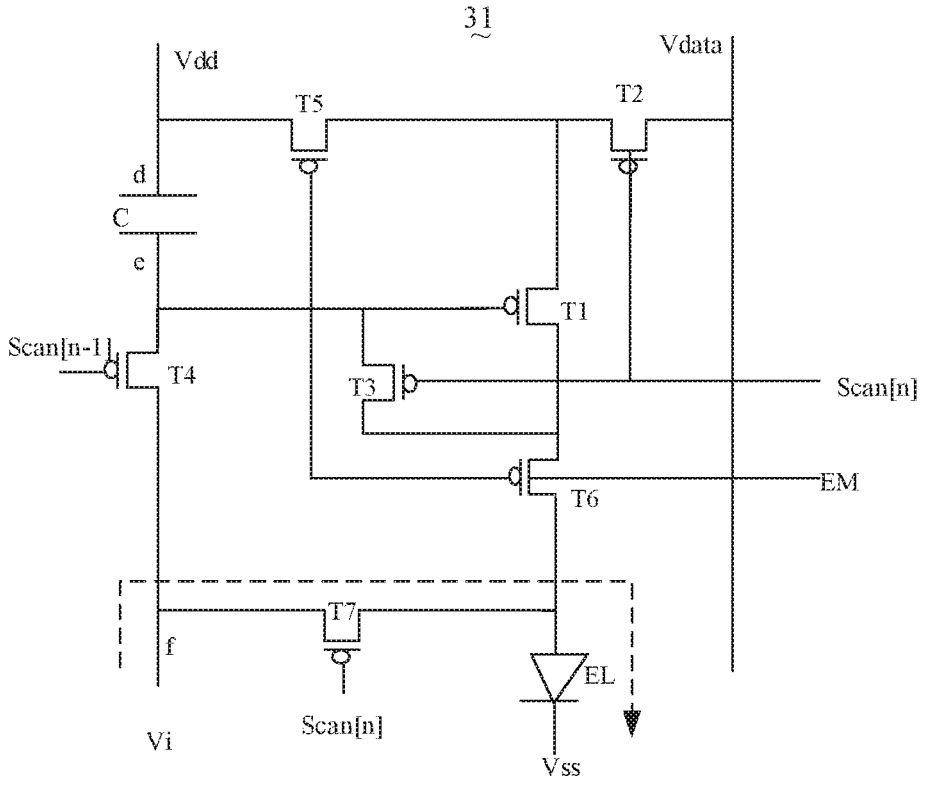
FIG. 3 is a schematic structural diagram of a subpixel unit according to another embodiment of the present disclosure.

Referring to FIG. 3, which is a schematic structural diagram of a subpixel unit according to another embodiment of the present disclosure. The pixel unit in this embodiment is a specific manifestation form of the subpixel unit 31 in the above embodiment. That is, the working principles of the test circuit 10 are specifically described in this embodiment by taking a 7T1C pixel circuit structure as an example. Of course, this embodiment may merely and schematically provide a specific structure of the pixel unit, while the pixel circuits in other embodiments may also be other structures, and no further limitation is made here. The pixel unit in this embodiment specifically may include following parts.

Corresponding to each functional module of the pixel unit in FIG. 2 respectively, the drive module 312 may include a capacitor C and a first transistor T1, wherein a first terminal d of the capacitor C may connect a first voltage Vdd, and a second terminal e of the capacitor C may connect a first terminal of the first transistor T1.

The reset module 31 may include a reset signal input terminal f connecting the reset signal line Vi and the drive module 312.

The compensation module 313 may include a second transistor T2, a third transistor T3, a fourth transistor T4, and a seventh transistor T7.

The light emission control module 314 may include a fifth transistor T5 and a sixth transistor T6.

The second terminal e of the capacitor C may connect a first terminal of the fourth transistor T4, a second terminal of the first transistor T1 may respectively connect a data voltage Vdata and the first voltage Vdd via the second transistor T2 and the fifth transistor T5. The first terminal of the first transistor T1 may also connect the anode of the EL light-emitting device via the sixth transistor T6. The anode of the EL light-emitting device connects the reset signal terminal f, and the cathode of the EL light-emitting device connects the common voltage VSS. The specific working processes of the 7T1C pixel circuit are not repeated any more herein.

The first transistor T1, the second transistor T2, the third transistor T3, the fourth transistor T4, the fifth transistor T5, the sixth transistor T6 and the seventh transistor T7 may be P-type field-effect transistors. Of course, these transistors may also be N-type field-effect transistors, and the first transistor Ti may be a drive transistor.

When the test circuit 10 is configured to detect electric current and analyze problems, a specific signal input may be as below.

First, a low level signal may be inputted from the enable signal line Enable, such that all the switch transistors T in the test circuit 10 may be enabled. In this embodiment, all the switch transistors T may be P-type field-effect thin film transistors. In other embodiments, when the switch transistors T are N-type field-effect thin film transistors, a high level signal may be inputted from the enable signal line Enable, which is not further limited herein.

Further, a low level may be inputted from the scanning signal ON line GON, such that a low level may be inputted to a gate line of the pixel unit 30. That is, a low level is inputted to corresponding scanning signal control lines Scan and Scan-1 at the same time, in which case, the second transistor T2, the third transistor T3, the fourth transistor T4 and the seventh transistor T7 may be enabled. In the meanwhile, a high level may be inputted from the reset signal line Vi, such that the first transistor T1 may be disenabled, and thus a high level may be inputted to the anode of the EL light-emitting device in the pixel unit 30. A low level may be inputted to the cathode of the EL light-emitting device by the common voltage VSS, such that the EL light-emitting device may be driven to emit light. In this process, when the light emission control line EM is in a floating state without input signal, the fifth transistor T5 and the sixth transistor T6 may be disenabled. When the first voltage Vdd and the data voltage Vdata is also in a floating state without input. Therefore, in the pixel unit at this moment, only the reset signal line Vi may act on a circuit formed by the anode of the EL light-emitting device via the enabled seventh transistor T7, none of other modules may form a circuit, thus detection of the electric current of the EL light-emitting device may be not affected. In a specific test process, causes of occurrence of problems may be determined, i.e., it may be determined whether causes of affecting current output characteristic parameters of the light-emitting device are from the drive circuit on the array substrate or from the light-emitting device itself by detecting parameters, such as current density and brightness curve of the EL light-emitting device, namely, by observing the relationship between the current and the voltage of the EL light-emitting device.

In this embodiment, in the process of testing the pixel unit 30 by the test circuit 10, the drive circuit provided by the array substrate may not or less be enabled. That is, in this test process, the drive circuit may do not affect the parameter characteristics of the EL light-emitting device detected by the test circuit 10. In other words, if the parameters of the EL light-emitting device detected by the test circuit 10 are wrong, this indicates that the EL light-emitting device itself may go wrong. If the parameters of the EL light-emitting device detected by the test circuit 10 are normal, this indicates that the problem may occur in the drive circuit of the array substrate.

Furthermore, according to the present disclosure, it is unnecessary to individually fabricate a mask (fine metal mask or common metal mask) for the EL light-emitting device to shield the effect of a drive circuit in the array substrate during EL recipe debugging. Therefore, product development costs may be saved. Moreover, the test circuit in the present disclosure may directly input, on the existing product, the reset signal, the enable signal, the scanning signal ON signal and the common voltage to the panel, such that the EL light-emitting device can emit light. The influence of the drive circuit on the array substrate may be directly shielded, and the current output characteristics of the EL light-emitting device may be detected, such that the location where the problem occurs may be determined.

Of course, the above embodiment may merely provide a pixel structure circuit. In practical applications, pixel structure circuits such as 6T1C, 5T1C, and 4T1C also may be used. As long as the above pixel structure circuits have light emission control line (EM), the above test circuit may be employed to check the pixel structure circuits, and the specific principle may be similar to that of the 7T1C pixel structure circuit. That is, in the event that the drive circuit on the array substrate may be less driven or even not driven, a high level may be inputted to the anode of the EL light-emitting device by means of the reset signal, and a low level may be inputted to the cathode of the EL light-emitting device by means of the common voltage Vss to form a circuit to turn on the EL light-emitting device, thereby detecting the current output characteristic for further analysis, with specific signal application process omitted herein.

In the above embodiments, by arranging the test circuit at the output terminal of the scan driving circuit to test the current output characteristic of the pixel unit without driving the scan driving circuit, a location having a negative effect on light emission of the EL light-emitting device may be determined, and it is unnecessary to individually fabricate a mask for the EL light-emitting device to shield the effect of a drive circuit in the array substrate during EL recipe debugging. Therefore, product development costs may be saved.

Figure 4:
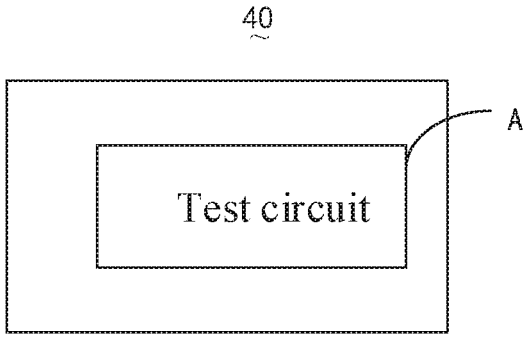
FIG. 4 is a schematic structural diagram of an array substrate according to an embodiment of the present disclosure.

Referring to FIG. 4, which is a schematic structural diagram of an array substrate according to an embodiment of the present disclosure. The array substrate 40 may include a test circuit A according to any one of the above embodiments. Reference is made to the specific description of the above embodiments for the specific structure and principles of the test circuit A, which are omitted herein.

Figure 5:
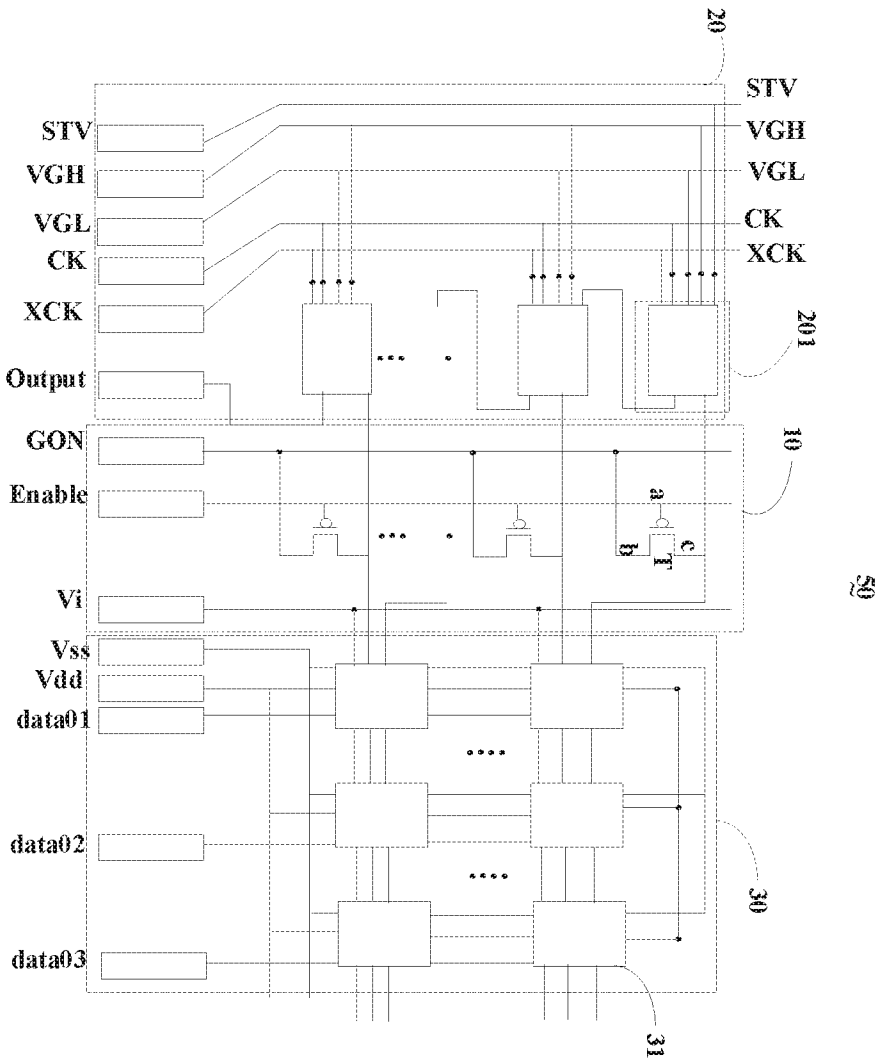
FIG. 5 is a schematic structural diagram of a light-emitting display apparatus according to an embodiment of the present disclosure.

Referring to FIG. 5, which is a schematic structural diagram of a light-emitting display apparatus according to an embodiment of the present disclosure. As shown in FIG. 5, the light-emitting display apparatus 50 may include a scan driving circuit 20, a pixel unit 30 and a test circuit 10 connected in sequence.

The test circuit 10 may be configured to test a current output characteristic of the pixel unit 30 when the scan driving circuit does not provide a drive signal for the pixel unit 30. The test circuit 10 further may include an enable signal line (Enable), a scanning signal ON line (GON), and a plurality of switch transistors T. Each of the switch transistors T may include a first terminal a, a second terminal b, and a third terminal c. The first terminal a of each of the switch transistors T may connect the enable signal line (Enable), the second terminal b connects the scanning signal ON line (GON), and the third terminal c may connect the pixel unit 30. The switch transistors T in this embodiment may be field-effect thin film transistors. The first terminal a, the second terminal b and the third terminal c may respectively correspond to a gate, a source and a drain of the field-effect thin film transistor (TFT). The field-effect thin film transistors in this embodiment may be N-type or P-type field-effect ones, which may be reasonably selected according to actual situations and are not further limited here.

Alternatively, the test circuit 10 may further include a reset signal line Vi, wherein reset signal line Vi may connect the pixel unit 30 to provide a reset signal to reset the pixel unit 30.

The scan driving circuit 20 may include a plurality of cascade-connected drive units 201. Each of the drive units 201 may further include a first clock signal input terminal (CK), a second clock signal input terminal (XCK), a first voltage input terminal (VGH), and a second voltage input terminal (VGL), etc. Furthermore, each of the drive units 201 may further include an initial signal input terminal (STV).

The light-emitting display apparatus 50 may further include a data driving circuit, etc. Reference is made to the specific description of the above embodiments for the specific structure and principles of the test circuit, which are omitted herein.

In conclusion, those skilled in the related art may readily understand that the present disclosure may provide a test circuit, an array substrate, and a light-emitting display apparatus. By arranging the test circuit at an output terminal of a scan driving circuit to test a current output characteristic of a pixel unit without driving the scan driving circuit, a location having a negative effect on light emission of the EL light-emitting device may be determined, and it is unnecessary to individually fabricate a mask for the EL light-emitting device to shield the effect of a drive circuit in the array substrate during EL recipe debugging. Therefore, product development costs may be saved.

The above are merely embodiments of the present disclosure and are not intended to limit the patent scope of the present disclosure. Any modifications of equivalent structure or equivalent process made on the basis of the contents of the description and accompanying drawings of the present disclosure or directly or indirectly applied to other related technical fields shall similarly fall within the scope of patent protection of the present disclosure.

What is claimed is:

1. A test circuit, arranged at an output terminal of a scan driving circuit and configured to test a current output characteristic of a pixel unit when the scan driving circuit does not provide a drive signal for the pixel unit;

the test circuit comprising:

an enable signal line;

a scanning signal ON line; and a plurality of switch transistors, each comprising:

a first terminal connecting the enable signal line;

a second terminal connecting the scanning signal ON line; and a third terminal connecting the pixel unit.

2. The test circuit according to claim 1, further comprising a reset signal line connecting the pixel unit and configured to provide a reset signal to reset the pixel unit.

3. The test circuit according to claim 2, wherein the pixel unit at least comprises:

a reset module, connecting the reset signal line and configured to reset the drive module based on a reset signal inputted from the reset signal line;

a drive module, configured to output a drive current to drive a light-emitting device to emit light;

a compensation module, connecting a signal control line and configured to compensate a threshold voltage and write data for the drive module under the control of a control signal inputted from the scanning signal control line; and a light emission control module, connecting a light emission control line, the drive module and an anode of the light-emitting device, and configured to control the drive module to drive the light-emitting device to emit light according to a light emission control signal inputted from the light emission control line.

4. The test circuit according to claim 3, wherein the reset signal line connects the anode of the light-emitting device and is configured to provide the reset signal in a test phase to reset the anode of the light-emitting device.

5. The test circuit according to claim 3, wherein a cathode of the light-emitting device connects a common voltage, and the common voltage provides a low level signal for the light-emitting device in a test phase.

6. The test circuit according to claim 1, wherein the switch transistors are field-effect thin film ones.

7. An array substrate, comprising a test circuit arranged at an output terminal of a scan driving circuit and configured to test a current output characteristic of a pixel unit when the scan driving circuit does not provide a drive signal for the pixel unit;

wherein the test circuit comprises:

an enable signal line;

a scanning signal ON line; and a plurality of switch transistors, each comprising:

a first terminal connecting the enable signal line;

a second terminal connecting the scanning signal ON line; and a third terminal connecting the pixel unit.

8. The array substrate according to claim 7, further comprising a reset signal line, and the reset signal line connects the pixel unit and is configured to provide a reset signal to reset the pixel unit.

9. The array substrate according to claim 8, wherein the pixel unit at least comprises:

a reset module, connecting the reset signal line and configured to reset the drive module based on a reset signal inputted from the reset signal line;

a drive module, configured to output a drive current to drive a light-emitting device to emit light;

a compensation module, connecting a signal control line and configured to compensate a threshold voltage and write data for the drive module under the control of a control signal inputted from the scanning signal control line; and a light emission control module, connecting a light emission control line, the drive module and an anode of the light-emitting device, and configured to control the drive module to drive the light-emitting device to emit light according to a light emission control signal inputted from the light emission control line.

10. The array substrate according to claim 9, wherein the reset signal line connects the anode of the light-emitting device and is configured to provide the reset signal in a test phase to reset the anode of the light-emitting device.

11. The array substrate according to claim 9, wherein a cathode of the light-emitting device connects a common voltage, and the common voltage provides a low level signal for the light-emitting device in a test phase.

12. The array substrate according to claim 7, wherein the switch transistors are field-effect thin film ones.

13. A light-emitting display apparatus, comprising a scan driving circuit, a pixel unit and a test circuit connected in sequence, wherein the test circuit is configured to test a current output characteristic of the pixel unit when the scan driving circuit does not provide a drive signal for the pixel unit;

wherein the test circuit comprises:

an enable signal line;

a scanning signal ON line; and a plurality of switch transistors each comprising:

a first terminal connecting the enable signal line;

a second terminal connecting the scanning signal ON line; and a third terminal connecting the pixel unit.

14. The light-emitting display apparatus according to claim 13, wherein the test circuit further comprises a reset signal line connecting the pixel unit and configured to provide a reset signal to reset the pixel unit.

15. The light-emitting display apparatus according to claim 14, wherein the pixel unit at least comprises:

a reset module, connecting the reset signal line and configured to reset the drive module based on a reset signal inputted from the reset signal line;

a drive module, configured to output a drive current to drive a light-emitting device to emit light;

a compensation module, connecting a signal control line and configured to compensate a threshold voltage and write data for the drive module under the control of a control signal inputted from the scanning signal control line; and a light emission control module, connecting a light emission control line, the drive module and an anode of the light-emitting device, and configured to control the drive module to drive the light-emitting device to emit light according to a light emission control signal inputted from the light emission control line.

16. The light-emitting display apparatus according to claim 15, wherein the reset signal line connects the anode of the light-emitting device and is configured to provide the reset signal in a test phase to reset the anode of the light-emitting device.

17. The light-emitting display apparatus according to claim 15, wherein a cathode of the light-emitting device connects a common voltage, and the common voltage provides a low level signal for the light-emitting device in a test phase.

18. The light-emitting display apparatus according to claim 13, wherein the switch transistors are field-effect thin film ones.

* * * * *